US005984622A

United States Patent [19]

Schum et al.

[11] Patent Number: 5,984,622

[45] Date of Patent: Nov. 16, 1999

[54] METHOD AND APPARATUS FOR SEPARATING A PREDETERMINED NUMBER OF SHEETS FROM A STACK OF SHEETS

[75] Inventors: Michael Schum, Cherry Hill, N.J.; Vladimir P. Vasiliev, Ste. Petersburg, U.S.S.R.; Oleg M. Gerasimov, Ste. Petersburg, U.S.S.R.; Alexander V. Kislov, Ste. Petersburg, U.S.S.R.

[73] Assignee: Asomm, Inc., Voorhees, N.J.

[21] Appl. No.: 09/032,859

[22] Filed: Mar. 2, 1998

Related U.S. Application Data

[63] Continuation-in-part of application No. 08/515,466, Aug. 15, 1995, Pat. No. 5,722,811.

[30] Foreign Application Priority Data

Aug. 29, 1994 [SU] U.S.S.R. ..... 94 032 558

[51] Int. Cl.[6] ..... B65H 3/48

[52] U.S. Cl. ..... 414/796; 271/97; 414/795.5; 414/801

[58] Field of Search ..... 271/97; 414/795.5, 414/796, 798.9, 801

[56] References Cited

U.S. PATENT DOCUMENTS

| | | | |
|---|---|---|---|
| 3,635,463 | 1/1972 | Stobb | 271/6 |
| 4,204,667 | 5/1980 | Klenk | 271/3.1 |
| 4,222,556 | 9/1980 | Chapman et al. | 271/3.1 |
| 4,306,684 | 12/1981 | Peterson | 239/597 |
| 4,635,921 | 1/1987 | Thomas | 271/94 |
| 4,986,731 | 1/1991 | Shinomiya | 414/798.9 |
| 5,092,578 | 3/1992 | Bergmeier et al. | 271/97 |
| 5,096,370 | 3/1992 | Mohr | 414/789.1 |
| 5,110,110 | 5/1992 | Wirz et al. | 271/98 |

FOREIGN PATENT DOCUMENTS

| | | | |
|---|---|---|---|
| 4227814 | 2/1993 | Germany | 271/97 |
| 1242334 | 9/1989 | Japan | 414/796 |
| 9011240 | 10/1990 | WIPO | 271/97 |

*Primary Examiner*—Janice L. Krizek
*Attorney, Agent, or Firm*—Edward Dreyfus, Esq.

[57] ABSTRACT

A method of and apparatus for separation from a stack of sheets a block of a predetermined number of sheets, the method including moving the stack in a forward direction, directing an air stream across one corner of the forward portion of the stack to spread the corners apart, sensing and counting the number of spread sheet corners that pass a predetermined location, and separating the group of sheets from the remainder of the stack when the sensed and counted sheets reach a predetermined number. Further directing a thin plane of air toward the corner and center of the sheets at said location to cause a greater space between the sheets in the group and the next sheet in the stack. Also, vacuum nozzles are provided to remove unwanted air from above and below the stack and group. With the group so formed, separation includes imparting lateral force on the group edges.

20 Claims, 12 Drawing Sheets

METHOD AND APPARATUS FOR SEPARATING A PREDETERMINED NUMBER OF SHEETS FROM A STACK OF SHEETS

RELATION TO OTHER PATENT

This is a continuation-in-part of U.S. patent application Ser. No. 08/515,466, filed Aug. 15, 1995, now U.S. Pat. No. 5,722,811.

BACKGROUND

This invention relates to a method and apparatus for separating sheet material, such as paper, from a stack and can be used in automated document processing equipment such as high speed accumulators or counters.

One of the problems that must be solved in order to build a successful automated document processing line, such as an envelope inserter or a binder, is an ability to separate and combine all of the sheets of a document into a group. Prior to separation, these sheets could have gone through printing, laminating or other processes and were accumulated into a large contiguous stack. Thus, it is necessary to separate predetermined number of sheets stacked, one after another, to form a complete document.

The most simple methods are performed by the means of friction or vacuum rollers, where single sheets are separated from the stack and then directed one at a time into a receiving device or accumulator. The number of separated and then directed sheets for assembly into a group is counted by the use of mechanical, optical, or other sensors. See, for example, the sheet separation in the apparatus of U.S. Pat. No. 4,222,556, Chapman et al., 1980. This single sheet separation yields high quality control of the quantity of individual sheets but drastically reduces the performance of an automated line.

Better performance can be achieved if separated sheets, directed into a receiving device, are overlapped or displaced against each other, as disclosed in U.S. Pat. No. 3,635,463 to A. Stobb, 1972 or U.S. Pat. No. 4,204,667 to E. Klenk, 1980.

In the known apparatus of U.S. Pat. No. 3,635,463, sheets from the stack are separated by the use of a rotating brush that pushes sheets at their edges. Separated sheets are transported to a receiving device where the quantity is determined by the measurement of the thickness of the accumulated group by the use of a sensor.

In the apparatus of U.S. Pat. No. 4,204,667, the sheets from the stack are offset by the transport with a narrow gap, and the quantity of sheets is determined by measuring the thickness of accumulated groups in assembly station.

Greater performance could be achieved if the quantity of sheets that are separated from the stack is predetermined and directed to a receiving device so that a block of predetermined number of sheets is delivered to the receiving device. In the known apparatus of U.S. Pat. No. 4,986,731 to T. Shinomiya, 1991, a predetermined quantity of sheets is separated from the stack by the use of the following method. Initially, the block is offset or partially separated in reference to the stack by the use of the special lever. Next, the block is thrown to the moving transport and arrives at a receiving device. The quantity of pages is determined by the depth of an offset lever that moves along the edge of the stack. High performance could be achieved by realizing this known patent. However, such performance will require the use of an extremely high precision mechanical device which, under high production conditions, is very difficult to implement and does not solve the problem of controlling the precise quantity of pages in a separated block.

SUMMARY OF OBJECTS OF THE INVENTION

The technical objective of the present invention is to achieve a high performance and high reliability method of separation of a block of sheets from the stack which method also provides a simple technical solution to control the precise quantity of separated sheets placed in the block.

The essence of one exemplary embodiment of the present invention is characterized in that at the stage of partial separation of the block of sheets from the stack, the sheets in the stack are held such that at least one edge of the foremost sheet is free and can be slightly bent. An air flow is established onto the upper or foremost surface of each sheet to bend the respective sheet free edge away from the stack and move the plane of this air flow across the stack from the first to the last sheet of a separated block. The time of the plane air flow moving across the stack is determined to be sufficient to provide a slight bend and partial separation from the stack at the edge of every sheet separated in sequence from the stack.

Another exemplary method and apparatus embodiments according to the principles of the present invention comprises a separating assembly that supports and guides the stack of sheets that are to be separated into groups of predetermined numbers of sheets. A fluff-up nozzle is provided to direct air or other suitable fluid through one, preferably an upper, corner of the forward portion of the stack. The fluff-up nozzle preferably produces a plane of air that intersects the forward-upper corner of the stack at an angle so that the fluff-up air spreads apart the individual sheets as the fluff-up air enters then exits the forward portion of the stack profile. The individual and spread sheets are counted by a suitable counter as they and the rest of the entire stack move forward, i.e. generally normal to the planes of sheets in the stack.

A second group separation nozzle can be provided to direct a thin plane of air generally aligned with but possible at a slight angle to the plane of each spread sheet and preferably directed to intersect the corner of each spread sheet passing the thin plane to move in the forward direction faster and a further distance than the next oncoming spread sheet and, in this way, widen the gap or space between the sheet that passed the thin plane and the next subsequent sheet. The sensor controller is placed to count the sheets as they pass the thin separation plane. The thin separation nozzle used in combination with the fluff-up nozzle enables a less sophisticated and less expensive mechanical separation device to be used to separate the counted group of sheets.

A further aspect of an exemplary embodiment is the provision of one or more smaller vacuum or suction nozzles that function to remove air from the top, forward and bottom, forward edges of the stack. These suction nozzles control the integrity of the stack and keep the individual sheets from prematurely flying away from the stack.

A further feature of the alternate embodiment includes applying a mechanical lateral force to one edge of the group of predetermined number of sheets to be separated from the stack causing the group to move laterally from the remainder of the stack. This action greatly decreases the time needed to physically separate the group from the stack even if the group includes one or more sheets.

DRAWINGS

Other and further objects and benefits provided by a system or method according to the present invention will become evident from the following detailed description of exemplary embodiments when taken in view of the appended drawings in which:

FIG. 1*a* is a diagrammatic side view representation of a stack of sheets.

FIG. 1*b* is a diagrammatic representation of the stack of sheets of FIG. 1*a* showing a principle of bending the sheets in the block according to one aspect of the present invention by introducing an airflow.

FIG. 2*a* is a diagrammatic perspective representation of the arrangement of FIG. 1*b* showing a number of sheets separated in a block by the principle shown in FIG. 1*b*.

FIG. 2*b* is a view similar to FIG. 2*a* of an alternate embodiment in which the sheets are bent at their corners into the block.

FIG. 3*a* is a schematic representation of an apparatus employing a principle of the present invention.

FIG. 3*b* is a front elevation taken at B—B of FIG. 3*a*.

DETAILED DESCRIPTION OF EXEMPLARY EMBODIMENTS

Figure 1A:
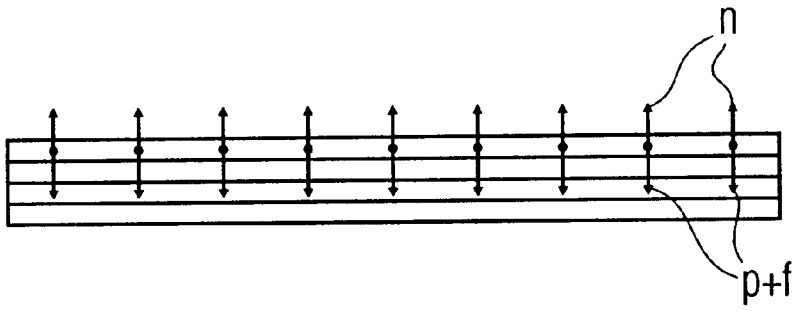
Figure 1B:
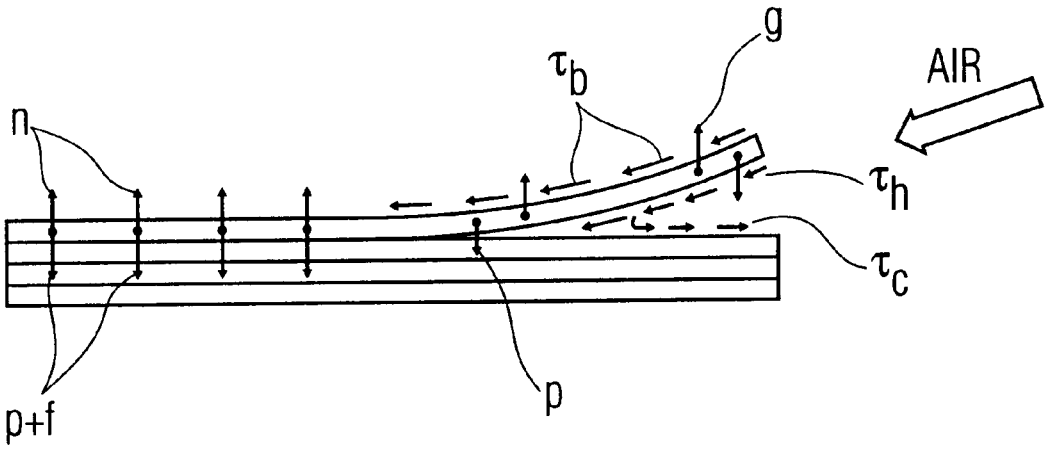

FIGS. 1*a* and 1*b* show the physical principles occurring during the supply of the planar air flow to the edge of the stack according to one embodiment of the present invention. FIG. 1*a* shows the distribution of a mechanical load on the top or foremost sheet of paper in the stack without an airflow, where: p=distributed weight force of the sheet, f=distributed cohesion force with the following sheet, n=distributed reaction force.

Therefore: n=p+f

Applying the stream of air flow to the foremost surface of the edge part of the stack in the general direction as shown in FIG. 1*b* develops on the external surface of the top sheet tangent forces $\tau_b$, that upon reaching a certain level will raise up the edge of the sheet. From that moment on in this part of the bent sheet the cohesion force f disappears. However, tangent $\tau_h$ and normal g stresses develop on the internal surface of the sheet, due to penetration of the air flow under the raised or bent sheet. Since the air flow breaks down under the sheet and gets distributed in the across direction, $\tau_b > \tau_h$. Simultaneously, the lower part of the air flow, interacting with an external surface of the following sheet due to the tangent stress $\tau_c$ retains this sheet against the stack.

Bending the edge of the top sheet and moving the plane of the air flow down across the stack reduces the stress $\tau_c$ and changes its direction to the opposite thus already developing the stress $\tau_b$ for the following sheet. Thus a process develops of bending up the second sheet analogous to the above shown top sheet. As a result, the edge of the following sheet is bent and separated. Thus, all of the bent sheets due to the growing stress g and disappearance of the force f are held in the bent condition.

Accordingly, unlike the prior known apparatus, the method according to the present invention applies originating forces that lead to sequential bending and separation of sheets from the stack. If, for any reason, two sheets begin to bend simultaneously, the stress $\tau_h$ provides the separation force for these sheets. Two sheets might tend to bend together due to accidental gluing or an electrostatic adhesiveness. The separation force was successfully confirmed in an experiment where two sheets were purposely attached to each other by a drop of glue.

According to one embodiment of the inventive method, the sheets should only bend and not to fly apart. Therefore, it is necessary to apply a holding force to the sheets in the stack for instance by the use of holders in the middle of the stack or an auxiliary air flow against the mid-to-rear portion of the stack. See FIG. 3 as described below.

Figure 2A:
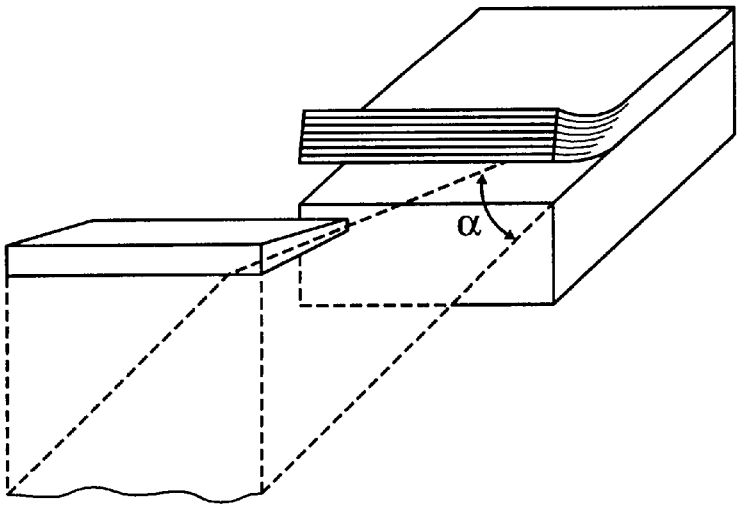
Figure 2B:
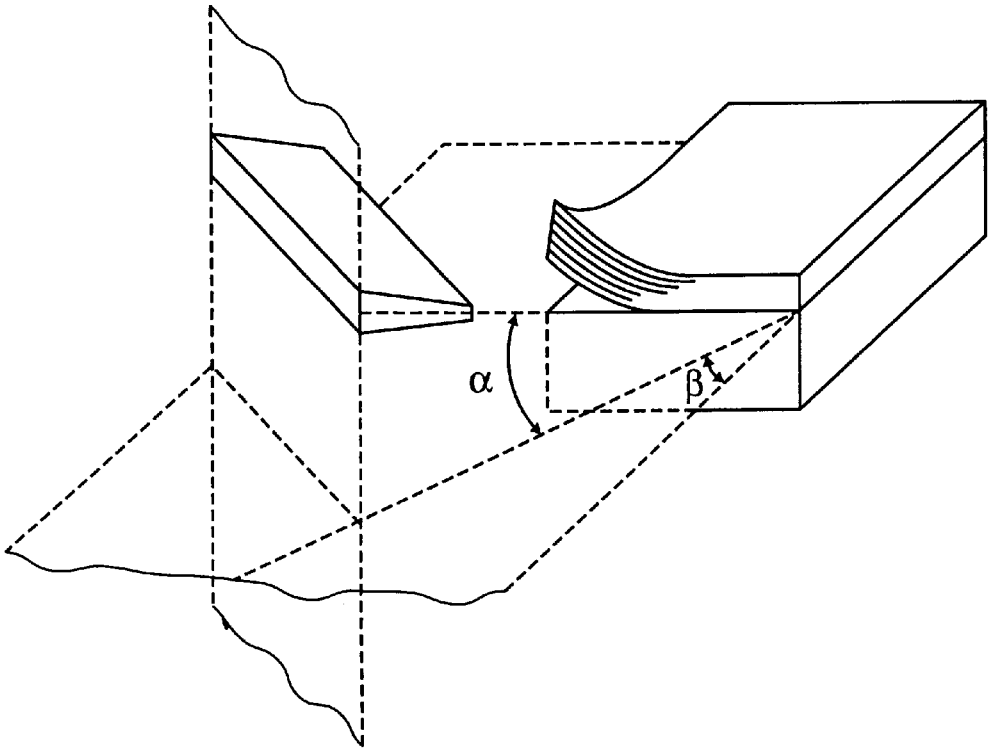

Bending a predetermined quantity of sheets from the stack is achieved by corresponding displacement of the front of the air flow across the stack from the first to the last sheet of a separated block of sheets. In addition, the fact that sheets are bent away from the stack in the consecutive order, one after another, creates a possibility to use a relatively simple, standard technical method such as photo sensors for additional control of the amount of separated sheets. FIGS. 2 a and b display example arrangements for implementing one embodiment of the present method. FIG. 2*a* shows the arrangement shown in FIG. 1*b* when the front of the air flow is oriented in parallel to one of the edges of the stack. Alternately, the air flow plane can be directed at a corner of the stack (FIG. 2*b*) Symbolization for FIGS. 2*a* and 2*b:*

$\alpha$-angle between the plane of the air flow and the plane of the sheets in the stack;

$\beta$- angle between the front of the air flow and one of the side corner edge of the stack (see FIG. 2*b*);

Several tests were performed to verify the working ability of the present method. In confirming the present method technical result, it has been determined that the optimum range of the angle $\alpha$ is in within 5°–10° of the planes of the sheets.

In addition, in order to enhance the forces for bending sheets away from the stack, the following steps can be taken:

ionizing air flow that would allow the surface of the sheets to be charged with identical polarity which will repel each other and aid the separation forces;

humidifying air flow for removing static charges, accumulated during printing or other processes, that causes the sheets in stack to be attracted or adhere to each other;

provide modulation in the narrow range of intensity of the air flow which tends to "fluff up" the very edges of the sheets.

The block of predetermined separated sheets can be separated from the stack of remaining sheets by simply mechanically gripping this block or dropping the block on to a transporting mechanism and into a receiving device. In order to simplify this procedure, it is possible, just before the separation of the block of sheets from the stack, to increase the air flow intensity by several times which increased air flow will substantially raise up or move the separated block of sheets.

Figure 3A:
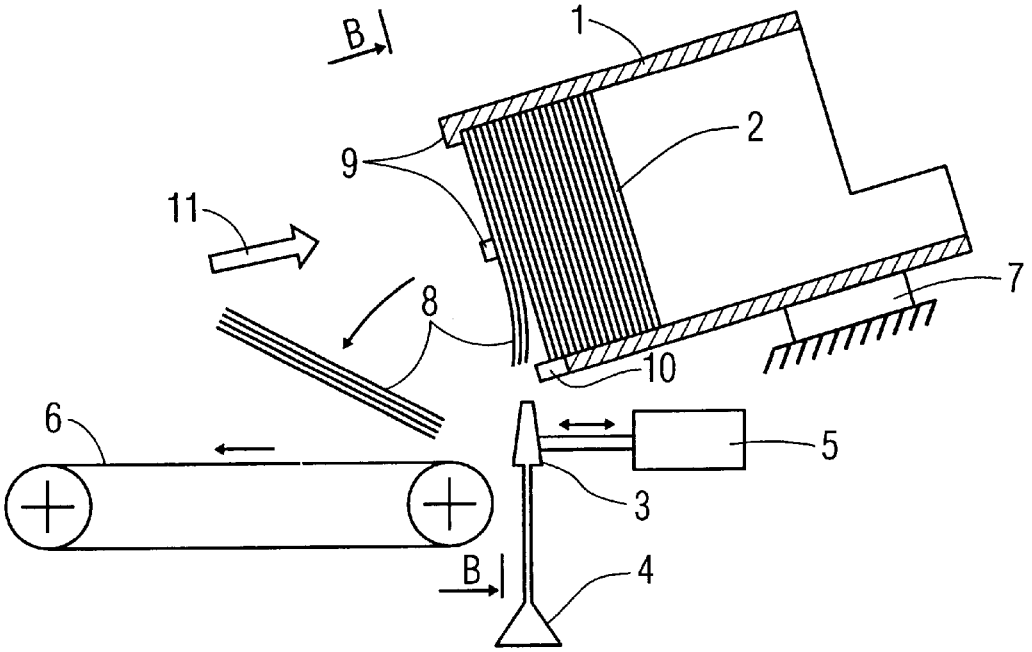
Figure 3B:
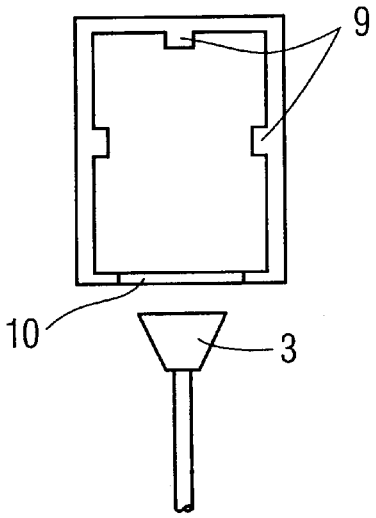

FIG. 3 a represents an exemplary embodiment of an apparatus that implements the present method shown in FIG. 2*a*. The apparatus includes hopper 1, where the stack of paper sheets 2 is placed, and injector 3 which is attached to compressed air supply 4. A displacement mechanism 5 positions injector 3, conveyor transport 6 transfers the block and vibrator 7 vibrates hopper 1. Hopper 1 can be a rectangular box adjustable to the size of sheets. In order to provide automatic advancement of stack 2 after separation of the sheets of block 8, hopper 1 is installed at an incline and is supported on vibrator 7. Sheets in stack 2 are held by use of stoppers 9, placed at the sides of the output part of hopper 1. The lower edge of the foremost sheets are free and can be bent. A cutout 10 in hopper 1 provides access of the air flow to lower and foremost edge of stack 2.

In operation, hopper 1 is loaded with stack 2. Displacement mechanism 5 positions injector 3 to direct air toward the foremost sheet of stack 2. Compressed air supplied by injector 3 bends the lower edge of each sheet as shown in FIG. 1*b*. Mechanism 5 displaces injector 3 along the edge of stack 2 to a predetermined distance along stack 2 to predetermine the quantity of sheets to bend and combine into the separated block 8. During this time, sheets are held by stoppers 9. For complete separation of block 8 from stack 2 intensity of air flow can be sharply increased by injector 3 to bow block 8 and release it from retaining the stoppers 9. The separated block 8 is then conveyed by transport 6 to a receiving device (not shown) for additional procedures.

To achieve a reliable holding of sheets in stack 2 during their bending, stoppers 9 should be relatively large, but, on the other hand, in order to push block 8 to transport 6 by the use of air flow, stoppers 9 should be, as small as possible. This contradiction is solved by creation of additional holding of sheets to stack 2 by use of additional air flow I 1, which is supplied only at the time of first phase of separation of sheets from stack 2 and not when block 8 is to be removed from the stack. Thus stoppers 9 could be implemented either of small size or completely removed.

Another exemplary method and apparatus according to the principles of the present invention includes directing a fluff-up airflow in a plane that extends generally along the longitudinal direction of travel of the stack of sheets such that the plane enters the stack along the common edges of the foremost sheets and exits the stack through the adjacent edges of the sheets, thus spreading apart the common corner edges of the foremost sheets from each other. A sensor and control apparatus counts the separated spread apart foremost sheets as the stack moves generally forward in the longitudinal direction. When a predetermined count is reached for the group of foremost sheets to be separated, the controller activates a mechanism to eject the last counted sheet from the next to be counted sheet.

Figure 4:
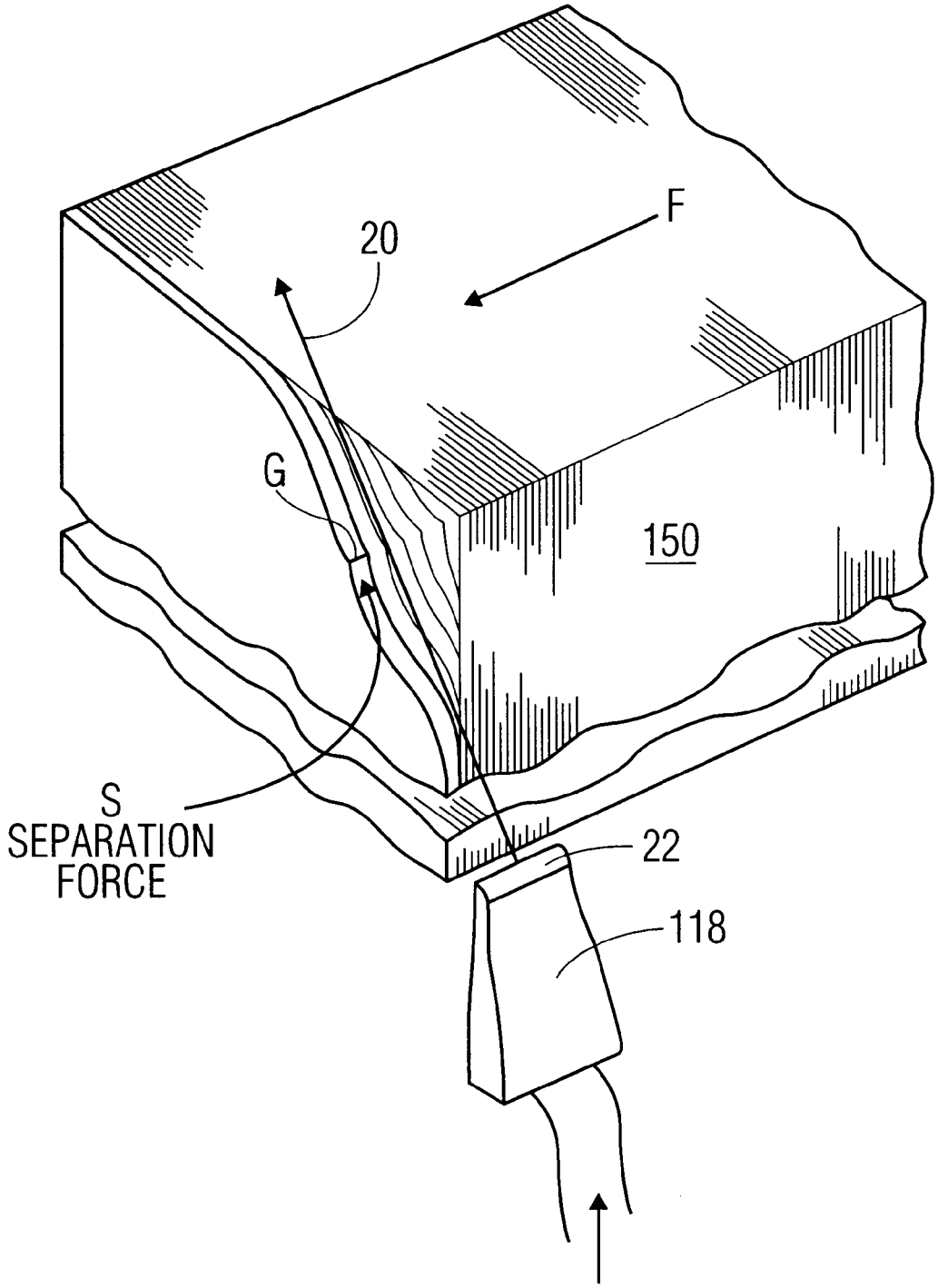
FIG. 4 is a front perspective pictorial view of a stack of sheets the upper left corners of the foremost sheets of which are grouped and spread according to another embodiment and method of the present invention.

We have discovered that the corners of sheets at the foremost or forward end of a stack can be spread or spaced apart by directing a plane of air or gas into one side of the forward portion of the stack such that it exits an adjacent side of the stack. One example of this technique is shown in FIG. 4, where the stack of sheets 150 is moved in the forward direction F generally normal to the planes of the sheets. A fluff-up nozzle 118, preferably at a stationary position, directs a plane or column of air upward from the side edge to exit the stack through the top edge generally as shown by the arrow 20. Nozzle 118 includes an exit port or jet 22 that is elongated in the longitudinal direction or the direction of movement F.

Figure 5:
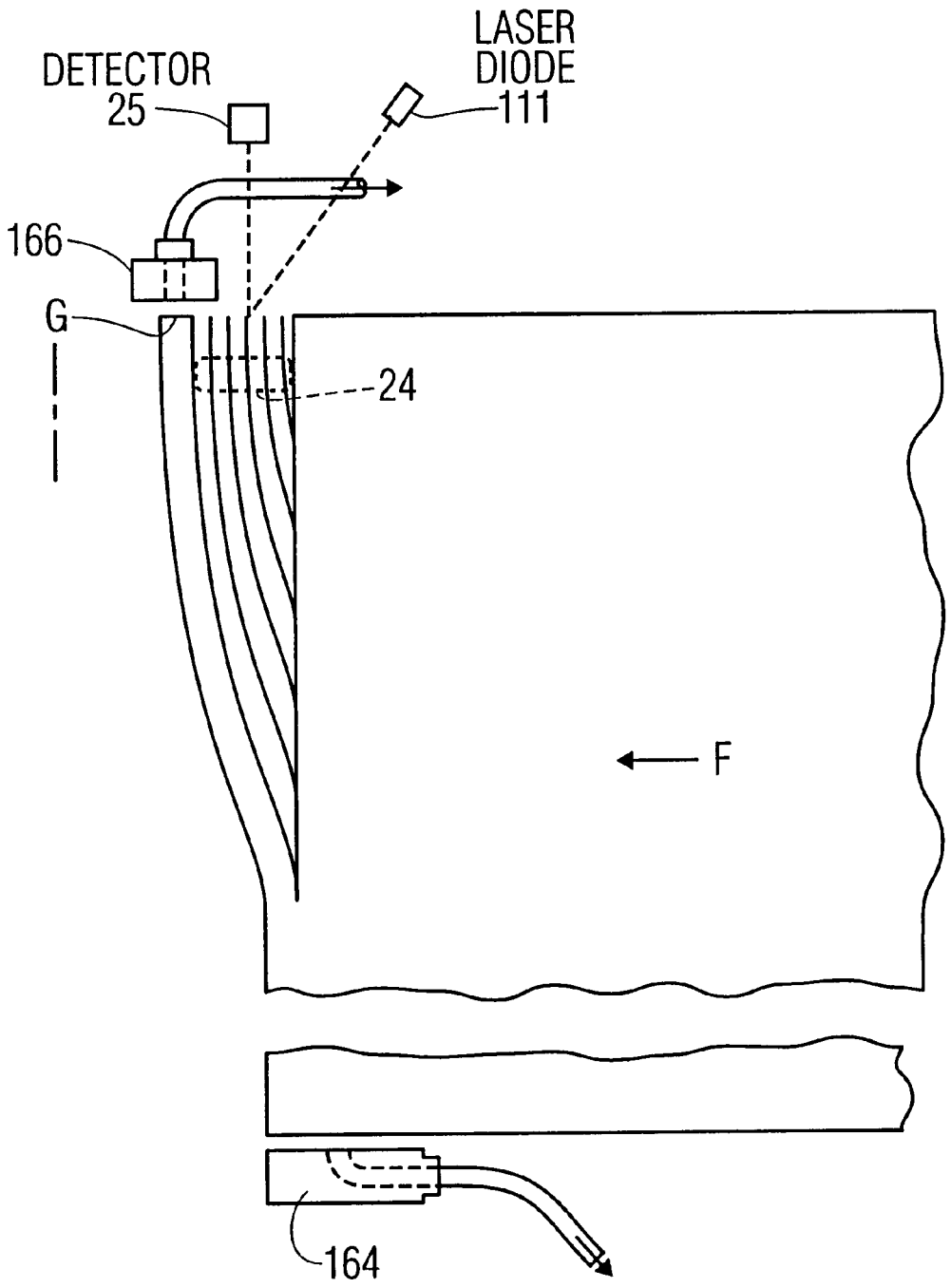
FIG. 5 is a side elevation of the group and stack of FIG. 4.

In operation, as the foremost sheets of the stack move into the plane of the airstream emitted from nozzle 22, they spread apart or bend forward. This action is represented in FIG. 5 where the dotted rectangle 24 represents the area or zone where the nozzle 118 air plane enters the left side of stack 150. It has been observed that the spacing between the sheet edges or corners are substantially uniform and in one example approximate 0.1 centimeters. As stack 150 continues to move left in FIG. 5, the foremost sheets move left of the nozzle 118 air stream and then tend to come together to form a group G. According to the method of this embodiment, a suitable apparatus can sense and count the individual sheets as they pass a predetermined position and enter the group G. For example, a laser diode 111 can direct light to the top edge of a sheet location and detector 25 senses each sheet passing that point. Once a predetermined number of sheets enter group G, a separation force S is applied to the group G of sheets such as shown in FIG. 4 to drive the group to the left for separation thereof.

Figure 6:
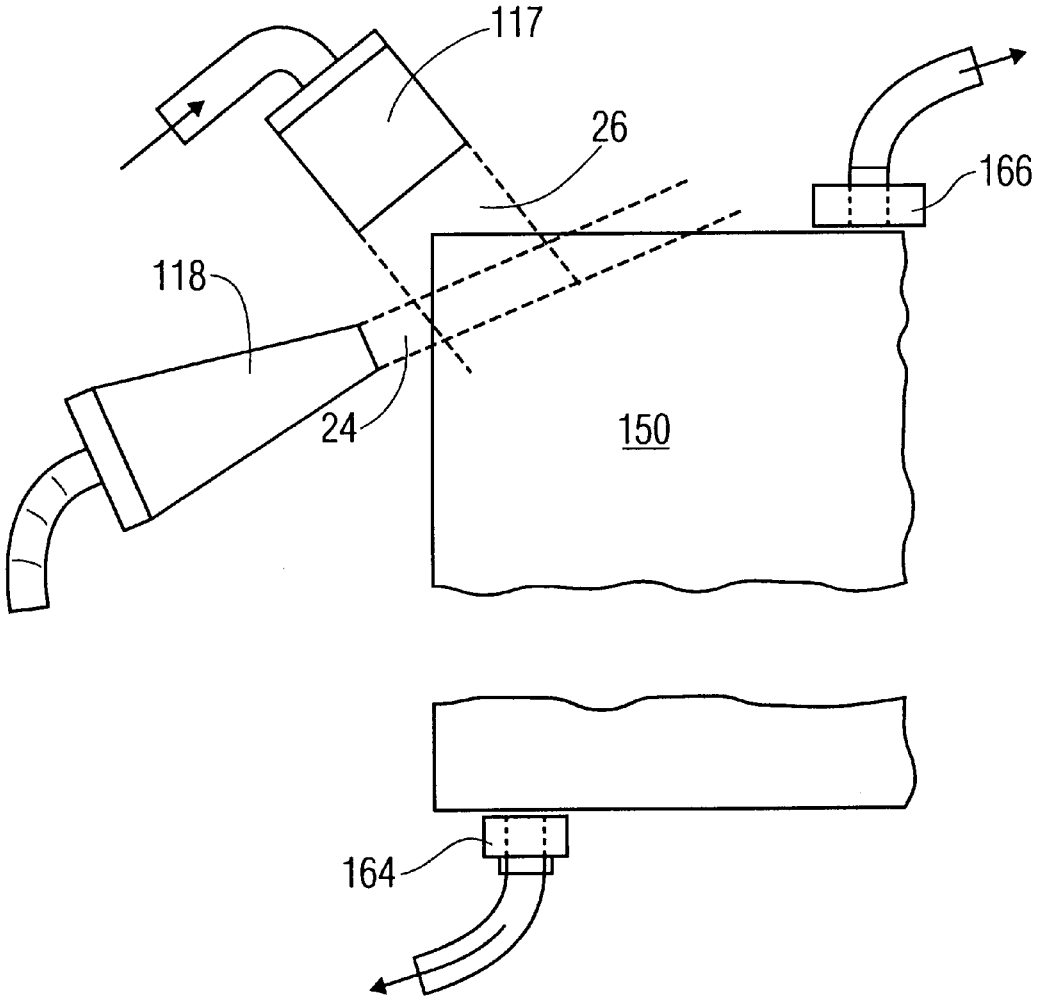
FIG. 6 is a rear pictorial view of FIG. 5 of a stack showing an alternate arrangement with a fluff-up nozzle and a separation nozzle directing air streams on the upper left hand corner of the stack.
Figure 7:
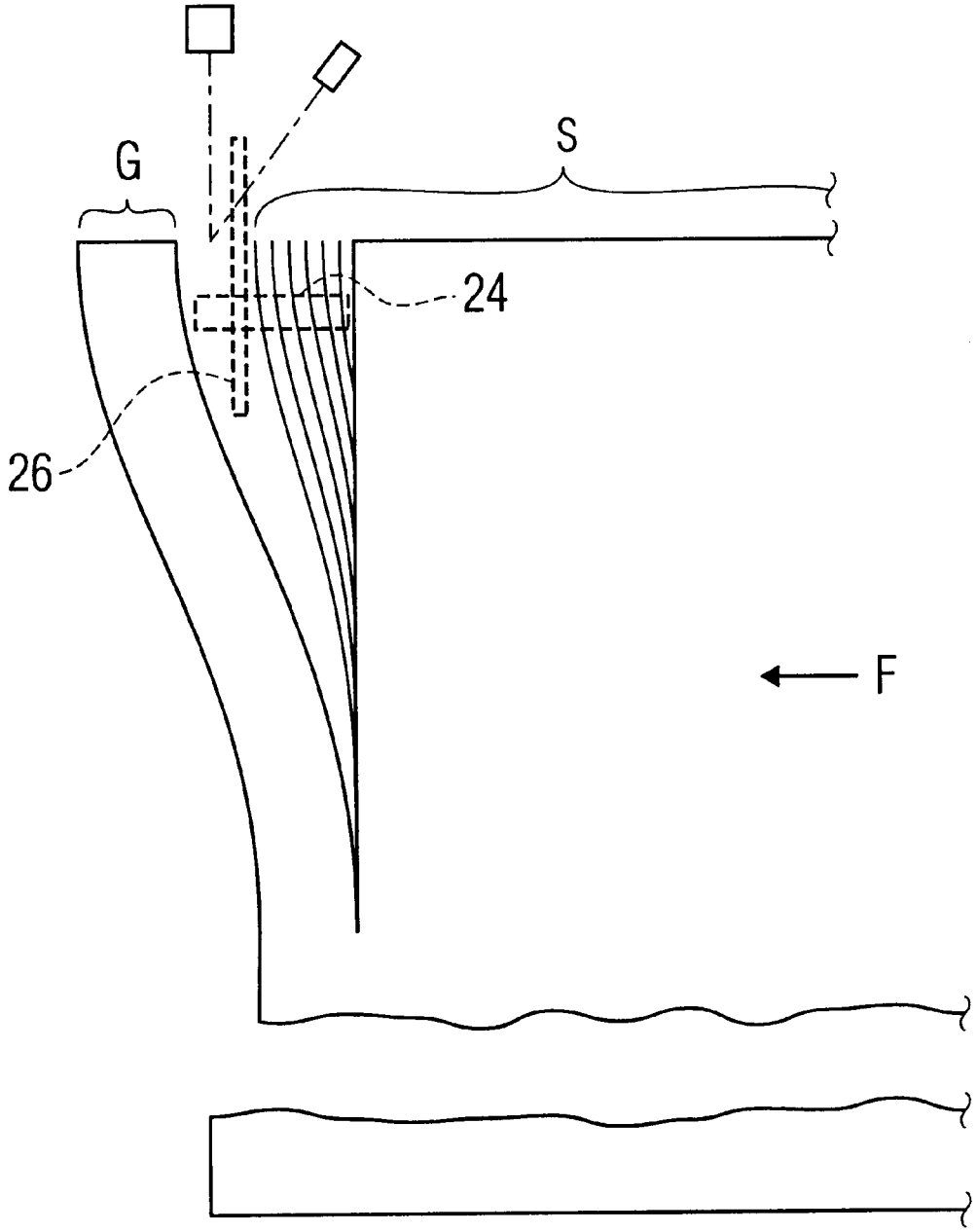
FIG. 7 is a left side elevation of the group and stack of FIG. 6.

We have also discovered that the method can better control the stack, the group and the transition therebetween by removing excess and unwanted air from near the forward top zone of the group or stack and from near the forward bottom of the group or stack. This action is shown by vacuum nozzle 164 located below the left bottom of stack 150 and nozzle 166 located above group G generally near the center of the stack. A further alternative method is shown in FIGS. 6 and 7 wherein a separation nozzle 117 is added to cooperate with nozzle 118 by directing a thin plane of separation air 26 toward the upper left corner of the stack and toward the center of the stack. Nozzle 117 is also stationary relative to nozzle 118 and causes sheets passing its plane to move to the left much more rapidly and a greater distance than the spacing between the sheets that have not yet arrived at plane 26. This action causes a wide gap or separation between the group G sheets and the remainder of sheets S in the stack. See FIGS. 7 and 8.

Figure 8:
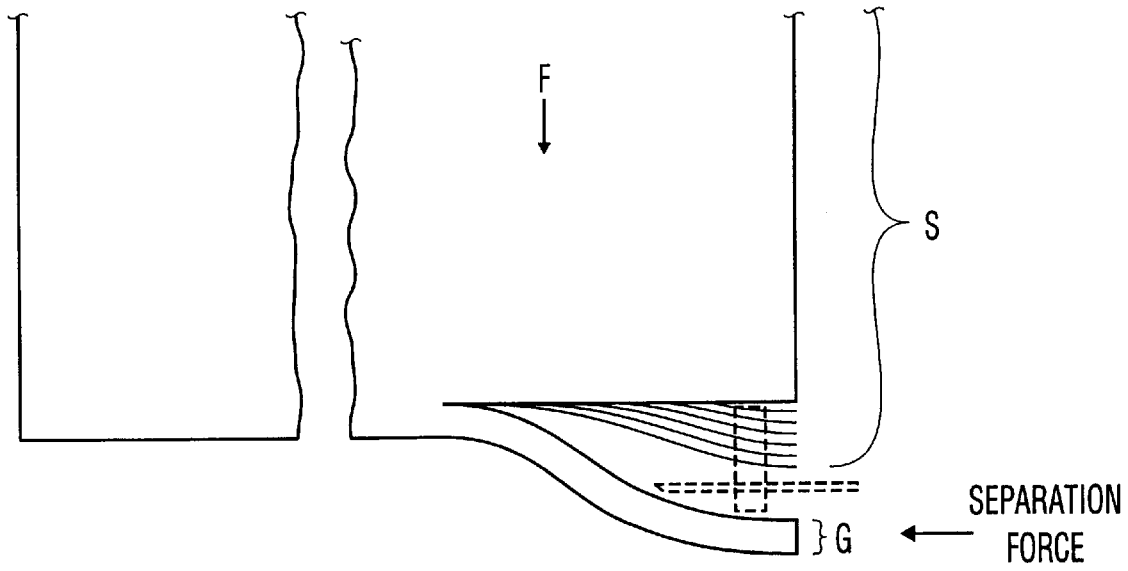
FIG. 8 is a top elevation of the group and stack of FIG. 7.
Figure 9:
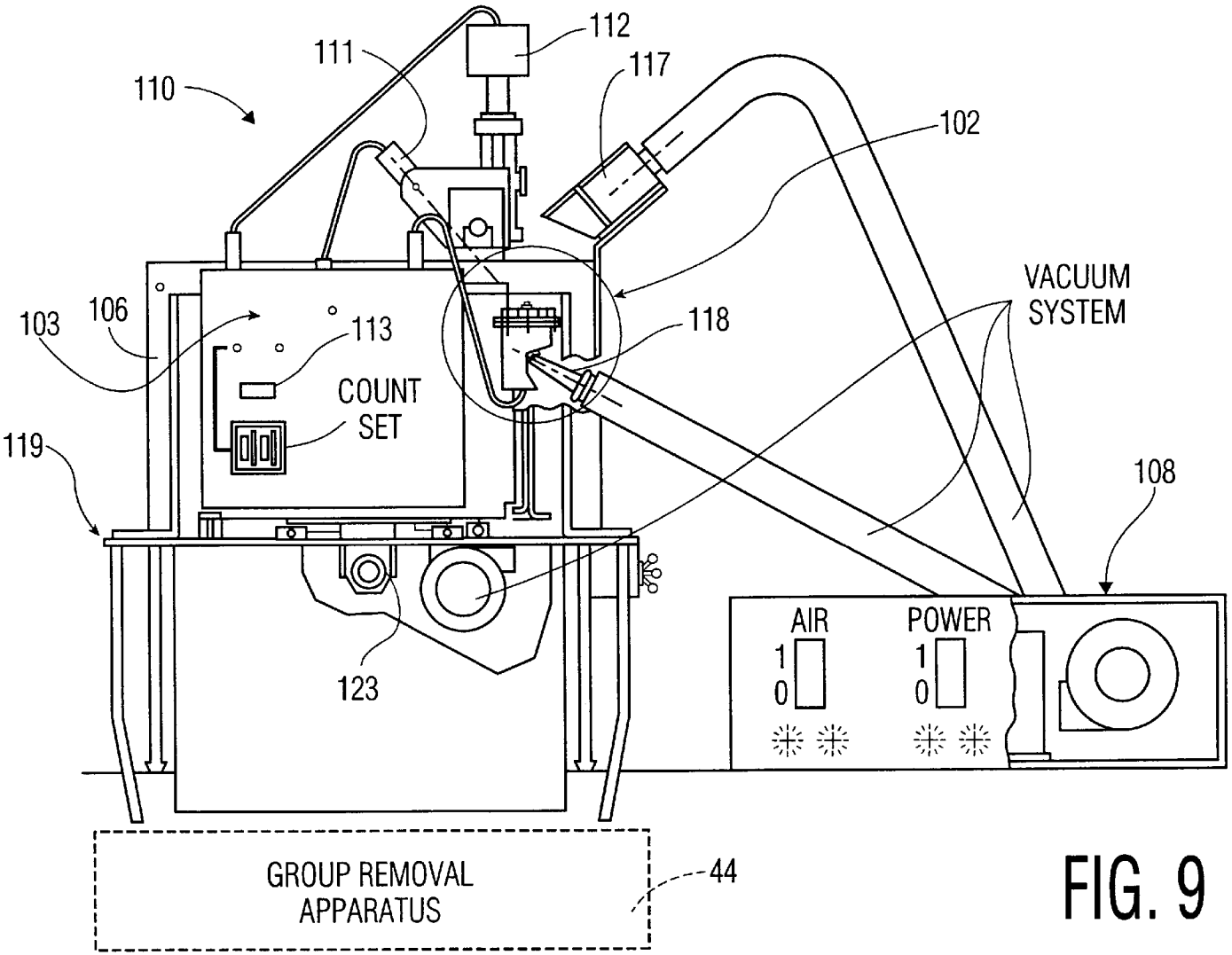
FIG. 9 is a front elevation of an exemplary apparatus for implementing the method of FIG. 8.
Figure 10:
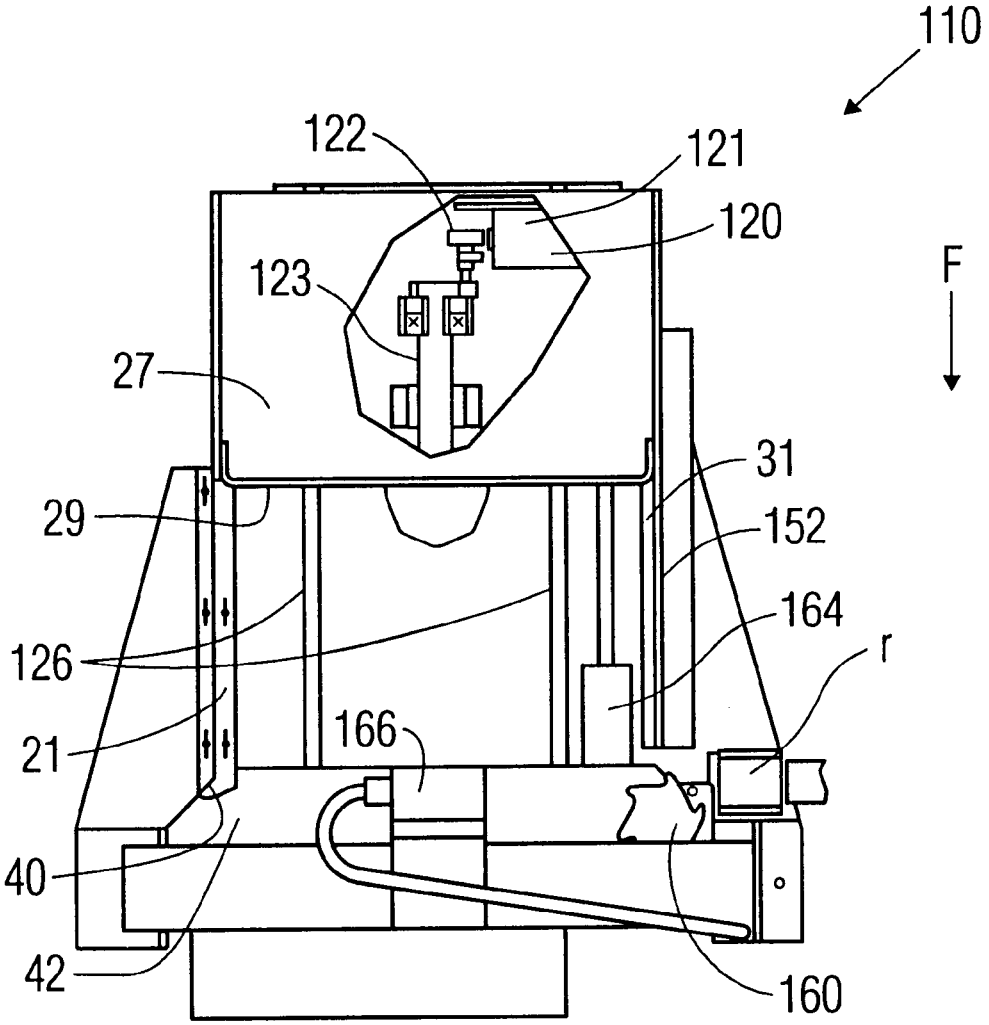
FIG. 10 is a partial top plan view of FIG. 9 with parts broken away.

One exemplary embodiment of Apparatus for carrying out the method of FIGS. 6–8 will now be described. FIG. 9 shows a front elevation of an exemplary group feeder embodiment 110 that includes a Frame 106 that includes side supports 31 that support a stack of sheets 150 (FIG. 12) on the edges of the individual sheets and guides the forward movement of the stack generally in a direction (arrow F) of the front or foremost sheet and generally normal to the upstanding sheets. As better seen in FIG. 10, base 106 includes carriage rods 126 upon which carriage 27 rides. Carriage 27 includes a stack pusher wall 29 that moves the stack forward. Side walls 21 and 152 also control and guide the stacked sheets 150. Carriage feed 120 mounted on base 106 comprises a DC motor 121, worm and cylinder gearing 122 and transmission shaft pair 123 coupled to sheet carriage 27 that serve to move the entire stack forward at a controlled and predetermined speed.

A group formation apparatus includes a fluff-up nozzle 118 and a separation nozzle 117 mounted on base frame 119 and coupled through air hoses to a suitable standard source of selectively settable pressurized air or other suitable fluid. Pressurized air is selectively supplied to each nozzle 117 and 118 under the control of electronic unit 108 as further described below. As better seen in FIGS. 9 and 12, nozzle 118 is oriented at a suitable angle, such as between 25–45%, to the vertical edge of sheets 150 so that air from nozzle 118 enters the vertical edges of the sheets and travels upward and toward the center of the sheets. Thus, nozzle 118 air travels between the sheets and exits the stack past the top edges of sheets 150. In addition, nozzle 118 is elongated in the longitudinal direction of the stack. See FIG. 12. Thus, the stream of air from fluff-up nozzle 118 spreads sheets 150 at the upper, forward, corner portion of the stack as the stack moves in the forward direction. We find it is preferred to spread the corner only and to remove excess air tending to spread the entire sheets.

Feeder 110 also includes sheet count controller 103 designed to register in unit 108 each individual sheet during sequential separation into the group of sheets and also provide control data to group separating apparatus 102. Sensing the individual sheets can be accomplished by any suitable sensor such as laser diode 111, photosensor with optical amplifier 112 and a counter with display 113 indicating the number of sheets in the group.

Nozzle 117 directs a thin plane of air into the corner generally as shown and described above. This causes a separation gap 32 to form as the individual sheets pass plane 26 one at a time and quickly enter group G. As better seen in FIG. 12, sheet corners in group G come to rest and are restrained by the flat part of sprocket wheel 160. Finger 162 of wheel 160 should have a length that can eject the anticipated maximum number if sheets in group G.

Figure 11:
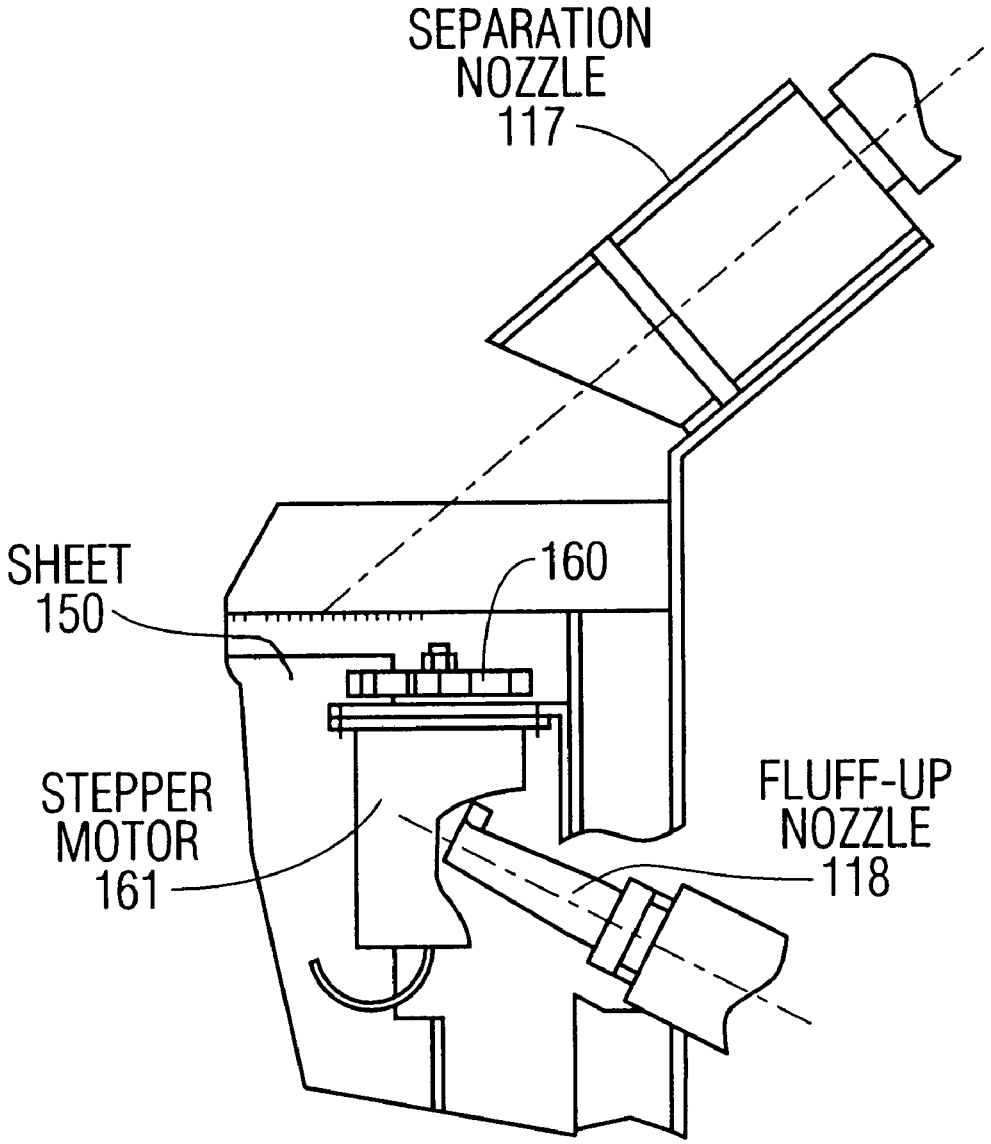
FIG. 11 is an enlarged front view of the upper right portion of part of FIG. 9.
Figure 12:
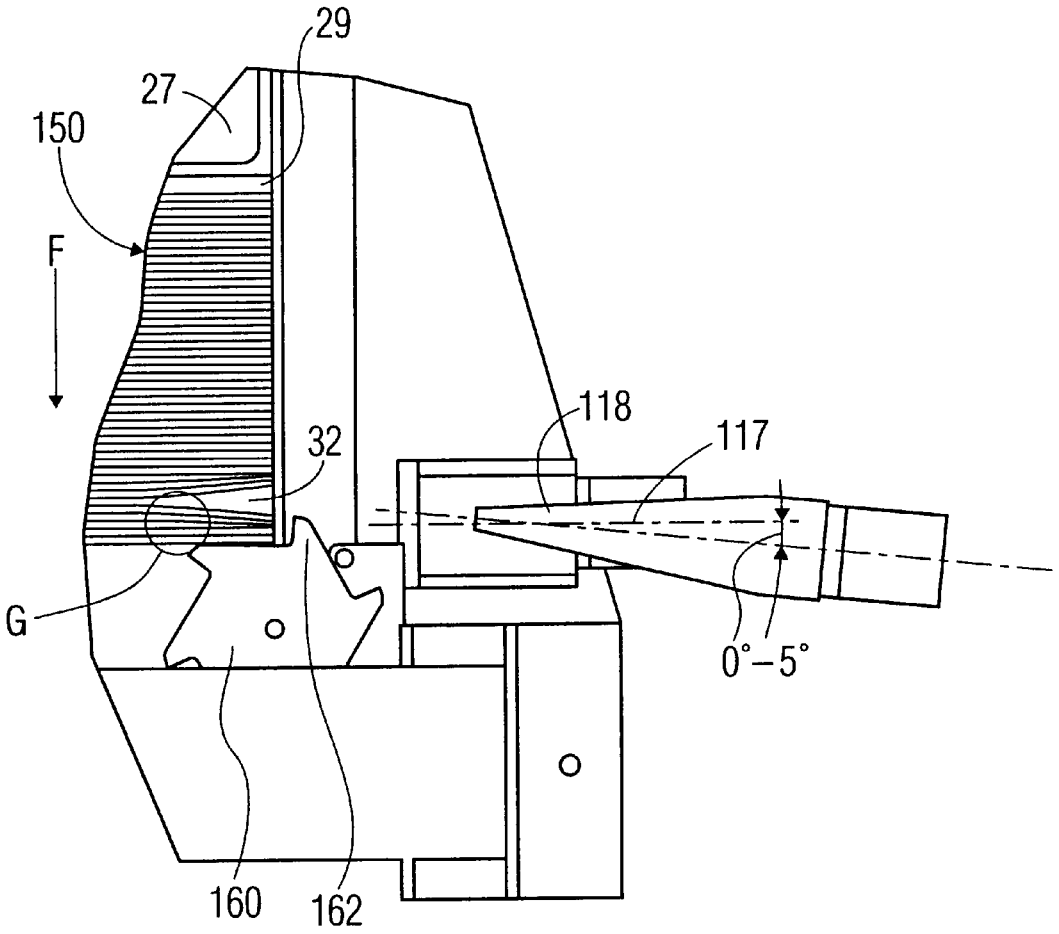
FIG. 12 is a top plan view of FIG. 11.

A preferred nozzle 117 shape and orientation can be seen in FIGS. 9, 11, and 12, that is a downwardly and inwardly facing plane of air that serves to force the aforementioned two sheets apart and thus widen the space between the last counted sheet and the rest of the stack. Nozzle 117 can also be oriented to face slightly, e.g. 1° to 5°, rearward or forward to assure that the sheet following the group of predetermined number of sheets does not pass the sensor location. With the corners of the predetermined number of sheets in the group so spaced from the corners of the rest of the stack, controller 103 applies power to stepper motor 161 to rotate sprocket wheel 160 counterclockwise in FIG. 12 one angular position. The upstanding finger 162 thereby contacts the edges of sheets forcing or ejecting them simultaneously to the left in FIG. 12, thereby separating the group from the remaining sheets in the stack. The separated group can then be guided or cammed forward from the next remaining sheet in the stack cam surface 40 (FIG. 10) or some other suitable surface. The group can then drop through space or opening 42 and be carried from the separating assembly by any suitable conventional means 44 such as a conveyor, blower, carriage, etc.

It should be understood that the feeder according to the present invention provides several cooperating features for maintaining positive and reliable control of the sheet handling and group separation functions. For example, since the air jets from nozzles 118 and 117 are preferably continuous, the fluff-up air 24 tends to force the separation air 26 upward and above the top sheet edges so the separation air 26 does not remain between sheets to cause problems or impedance to sheet movement. In addition, lower vacuum nozzle 164 and upper vacuum nozzle 166 serve to remove excess air from the lower forward side separation corner of the stack and from the upper center region of the forward portion of the stack to assure the separated group and forward portion of the stack of sheets do not entrap unwanted or excess air between the sheets.

The application of the present invention is not limited to separation of paper sheets. This present invention can also be used for separation of relatively light and flexible metal sheets (foil), sheets of plastic, or film.

We claim:

1. A method of separating from a stack of sheets a group of a predetermined number of sheets, the method comprising:

directing a fluff-up air stream through one corner of the sheets in the foremost portion of the stack to spread apart the corner portion of said sheets, sensing each spread sheet that passes a predetermined location, each sheet that passes said predetermined location becoming a part of a group, counting the number of sensed spread sheets that become part of the group, and separating the sheets in the group from the remaining sheets in the stack in response to the count reaching a predetermined number.

2. The method of claim 1 wherein the stack has a longitudinal axis and moves in a direction of travel parallel to the longitudinal axis of the stack, said fluff-up air stream being elongated in the direction of travel of the stack and enters the stack through one edge of the stack and exits the stack through an adjacent edge of the stack.

3. The method of claim 2 further comprising withdrawing at least part of said fluff-up air stream from the edge of said stack substantially where the fluff-up air stream exits the stack.

4. The method of claim 2 wherein said sensing includes directing radiant energy toward said predetermined location, causing the edges of the spread sheets to pass said location so that radiant energy is reflected from the sheet edges and sensing said reflected radiant energy.

5. The method according to claim 2 further comprising mechanically restraining the group of sheets from further spreading and applying a lateral force on the edges of at least some of the sheets in the group to separate the group from the remaining sheets in the stack.

6. The method of claim 2 further comprising directing a separation air stream toward the spread sheets to increase the space between the group of sheets and the next sheet in the stack.

7. The method of claim 6 wherein the separation air stream comprises a thin plane of air.

8. The method of claim 7 wherein the separation air stream is directed to intersect the fluff-up air stream intermediate of the longitudinal extent of the fluff-up air stream.

9. The method of claim 8 wherein the separation air stream lies in a thin plane and is directed substantially normal to the direction of travel of the stack and intersects said two edges of said stack.

10. The method of claim 9 further comprising withdrawing at least part of said fluff-up air stream from the edge of said stack substantially where the fluff-up air stream exits the stack, and establishing a vacuum near the stack edge opposite from the edge through which the fluff-up air stream exits.

11. A group feeder for separating from a stack of sheets a group of a predetermined number of sheets, the feeder comprising:

a nozzle directing a fluff-up air stream through one corner of the sheets in the foremost portion of the stack to spread apart the corner portion of said sheets, means for sensing each spread sheet that passes a predetermined location, each sheet that passes said predetermined location becoming a part of the group, means for counting the number of sensed spread sheets that become part of the group, and an ejector for separating the sheets in the group from the remaining sheets in the stack in response to the count reaching a predetermined number.

12. The feeder according to claim 11 wherein the stack has a longitudinal axis and moves in a direction of travel parallel to the longitudinal axis of the stack, said fluff-up air stream being elongated in the direction of travel of the stack and enters the stack through one edge of the stack and exits the stack through an adjacent edge of the stack.

13. The feeder according to claim 12 wherein at least part of said fluff-up air stream is withdrawn from the edge of said stack substantially where the fluff-up air stream exits the stack.

14. The feeder according to claim 12 wherein said means for sensing includes means for directing radiant energy toward said predetermined location, and further including means for causing the edges of the spread sheets to pass said location so that radiant energy is reflected from the sheet edges and said means for sensing can sense said reflected radiant energy.

15. The feeder according to claim 12 further comprising means for mechanically restraining the group of sheets from further spreading and for applying a lateral force on the edges of at least some of the sheets in the group to separate the group from the remaining sheets in the stack.

16. The feeder according to claim 12 further comprising a separation nozzle for directing a separation air stream toward the spread sheets to increase the space between the group of sheets and the next sheet in the stack.

17. The feeder according to claim 16 wherein the separation air stream comprises a thin plane of air.

18. The feeder according to claim 17 wherein the separation air stream is directed to intersect the fluff-up air stream intermediate of the longitudinal extent of the fluff-up air stream.

19. The feeder according to claim 18 wherein the separation air stream lies in a thin plane and is directed substantially normal to the direction of travel of the stack and intersects said two edges of said stack.

20. The feeder according to claim 19 further comprising a first device for withdrawing at least part of said fluff-up air stream from the edge of said stack substantially where the fluff-up air stream exits the stack, and a second device for establishing a vacuum near the stack edge opposite from the edge through which the fluff-up air stream exits.

* * * * *